United States Patent [19]

Kozma, Jr.

[11] Patent Number: 4,900,061

[45] Date of Patent: Feb. 13, 1990

[54] SNOW REMOVAL DEVICE

[76] Inventor: William Kozma, Jr., 2811 Stokes Canyon Rd., Calabasas, Calif. 91302

[21] Appl. No.: 267,751

[22] Filed: Nov. 1, 1988

Related U.S. Application Data

[63] Continuation-in-part of Ser. No. 161,394, Feb. 22, 1988, abandoned, which is a continuation-in-part of Ser. No. 135,726, Dec. 21, 1987, abandoned.

[51] Int. Cl.[4] ..... A63C 11/18

[52] U.S. Cl. ..... 280/813

[58] Field of Search ..... 280/813

[56] References Cited

U.S. PATENT DOCUMENTS

| | | | |
|---|---|---|---|
| 3,028,617 | 4/1962 | Racina | 280/813 |
| 3,556,667 | 1/1971 | Kaufman | 15/159 A X |
| 3,751,832 | 8/1973 | Baryluk | 280/813 |
| 4,507,361 | 3/1985 | Twilley et al. | 15/159 A X |

FOREIGN PATENT DOCUMENTS

| | | | |
|---|---|---|---|
| 2344260 | 3/1975 | Fed. Rep. of Germany | 280/813 |
| 2514632 | 10/1976 | Fed. Rep. of Germany | 280/813 |
| 2607760 | 9/1977 | Fed. Rep. of Germany | 280/813 |
| 2648415 | 4/1978 | Fed. Rep. of Germany | 280/813 |
| 2702233 | 7/1978 | Fed. Rep. of Germany | 280/813 |
| 2247264 | 5/1975 | France | 280/813 |
| 2263008 | 10/1975 | France | 280/813 |
| 50842 | 1/1910 | Switzerland | 280/813 |
| 637841 | 8/1983 | Switzerland | 280/813 |

*Primary Examiner*—David M. Mitchell
*Assistant Examiner*—Tamara L. Finlay
*Attorney, Agent, or Firm*—Elliott N. Kramsky

[57] ABSTRACT

A snow removal device for use in conjunction with a runner of a ski assembly, which comprises a pedestal and a plurality of upright bristles. The pedestal is secured fixedly to the runner, while the bristles are affixed to the pedestal. In this manner, the pedestal at an inclined forward angle to the ski provides the necessary height to the bristles and the bristles provide maximum digging action to remove snow and ice while maintaining a smooth and easy motion of the boot. The bristles are fabricated of the proper designs and material to prevent filling with snow and ice and thereby avoid freezing solid or breaking during use. The pedestal is arranged in a transverse manner to the runner at a predetermined distance forward of the toe piece of the binding mechanism. Alternatively, the pedestal may be formed integral with the toe piece base plate or may be incorporated into a base plate onto which the top piece mounts. In this way, the removal snow is deposited away from the binding.

5 Claims, 4 Drawing Sheets

SNOW REMOVAL DEVICE

This application is a continuation-in-part of application Ser. No. 161,394, filed Feb. 22, 1988, now abandoned which is a continuation-in-part of application Ser. No. 135,726, filed Dec. 21, 1987, now abandoned.

BACKGROUND

1. Field of the Invention

The present invention relates in general to winter sports equipment. More particularly, this invention pertains to a snow removal device which is adapted for use in conjunction with a ski assembly.

2. Description of the Prior Art

Ski assemblies of the general type with which the present invention is concerned are well known as winter sports equipment. A conventional ski assembly generally includes a pair of hand-engageable poles and a pair of foot-engageable runners. Each runner is secured to a binding mechanism which comprises a toe piece and a heel piece for respectively engaging the toe portion and the heel portion of the ski boot. The toe piece and the heel piece of the binding mechanism are generally adjusted so as to receive the ski boot with the undersole lying flat on the runner, such that a substantially narrow clearance space is maintained between the toe and heel pieces of the binding mechanism and the corresponding toe and heel portions of the ski boot.

One wide-spread problem associated with the skiing exercises is the buildup of snow within the crevices of the undersole of the ski boot prior to the skier stepping into the binding mechanism. Such common problem can be a serious source of concern. In fact, when the snow is compressed within the crevices of the undersole, it tends to freeze over into solid ice and to elevate the undersole above the runner level. Therefore, the boot would not readily engage the binding mechanism of the ski runner.

A commonly attempted solution has been to force the ski boot in a tight-fitting manner into the binding mechanism. Such technique has not proven to be satisfactory in that it presents a hazardous situation to the skier. In this regard, due to the unduly tight engagement with the ski boot, the binding mechanism tends to lock, but not to release timely, such as during a fall.

The inconvenience and danger concerning snow buildup is accentuated when the binding mechanism becomes frozen due to the compressed ice within the crevices of the undersole, and thus to become frequently inoperable. Furthermore, such concerns become increasingly acute for beginners whose safety relies heavily on the timely and frequent release of the binding mechanism. More particularly, such concerns are rendered more obstinate on steep slopes and in deep snow, where it would be awkward, if not impossible to remove the jammed snow from the crevices of the undersole.

Wherefore, several techniques have been attempted to purge the boot undersole from the packed snow, none of these conventional techniques has proven to be completely successful or practical. One such technique has been mentioned in the foregoing description, namely, to force the boot into engagement with the binding mechanism.

Another commonly attempted technique is to strike the boots with the ski poles so as to cause the snow to be extricated from the crevices of the undersole. Such method is not particularly effective in that the repeated impact of the poles against the boots can cause damage to the poles as well as to the boots. Furthermore, while the use of such technique may cause some powdery snow to be purged from the crevices, it does not help in releasing the compacted ice therein.

Yet another attempt to the snow buildup has been to scrape the snow by means of a relatively sharp object, or in the alternative to scrape the boot undersole on the sharp edge of the toe piece of the binding mechanism. Such process is awkward and particularly difficult to achieve on a steep slope or in deep snow. Additionally, the warm ski clothing generally renders the bending and scraping difficult to perform. Moreover, the scraping of the undersole with a sharp-edged object such as the toe piece can cause damage to the boots, as well as to the ski binding.

Other obviously non-practical solutions have been to remove the snow manually with the ski gloves, or to have someone else attempt to remove the packed snow.

Attempts have been made in the past to address the problem of removing snow from the bottom of ski boots by mounting a scraper directly upon the ski, either forward or behind the binding. Representative art in this regard includes the West German patents of Tuchenhagen, Sportartikef, Artinger, Hafe and Hass (Ser. Nos. 23 44 260, 26 07 760, 25 14 632, 26 48 415 and 27 02 233 respectively), Swiss patent Ser. No. 637 841 of Mettler and the French patents of Corn and Eymard (Ser. Nos. 2 263 008 and 2 247 264 respectively.) The Hass patent shows a scraper that extends above the binding to provide clearance. Hafen and Artinger teach scrapers that are attached in a transverse or angled manner on the ski. Such devices are subject to "catching" or "jamming" into the crevices found on the bottom of a conventional ski boot when one attempts to scrape off accumulated snow. As a result, the devices are uncomfortable and difficult to use and, over time, may cause damage to the sole of the boot.

Baryluk, U.S. Pat. No. 3,751,832 for "Ski Boot With Cleaning Device" teaches the use of a brush attached to a ski boot. Such an arrangement requires the skier to employ an awkward stance during use and requires unusually CIP good balance. The device additionally requires the drilling and modification of the boot which is esthetically unpleasing and potentially harmful to both the life and usefulness of the boot.

Racina, U.S. Pat. No. 3,028,617 for "Golf Shoe Cleat Cleaner" teaches a shoe cleat cleaner that utilizes bristles. Such device employs vertical bristles that are attached to a two-section mounting bracket. Such a construction cannot provide sufficient "digging" force to remove packed snow and ice from a ski boot. Further, standard nylon bristles absorb water and can become brittle and break at cold temperatures. Metal bristles, suggested by Racina, present safety problems while the short bristles of Racina tend to fill with snow and are subject to freezing solid thereafter rendering the device ineffective. The scraper arrangements with recessed areas shown in both Sportartikef and Artinger are subject to similar processes that could render those devices useless.

A scraper mounted above the binding is shown in Tuchenhagen. Such a location is undesirable due to the potential for damage to the binding in use. Further, snow falling from such a scraper into the binding can prevent proper insertion of the boot.

Therefore, it would be highly desirable to have a snow removal device which is adapted for use in conjunction with a ski assembly. The device should be effective and simple to use and to install on substantially most if not all existing ski assemblies. The device should achieve substantial economy for mass production and series manufacture, and it should facilitate the insertion of the boot in the ski binding. The snow removal device should not cause damage to either the binding mechanism, the boots or the ski poles.

The device should provide a strong digging force to remove ice and snow, and should release such material in an area that is removed from the binding.

SUMMARY OF THE INVENTION

The present invention overcomes the foregoing and additional shortcomings of the prior art by providing, in a first aspect, a snow removal device for use in conjunction with a runner of a ski assembly. Such a runner has a pair of generally parallel side edges, a toe piece and a heel piece. The device of the invention includes a polyethylene pedestal that is fixedly secured to the runner. A plurality of thermoplastic upright bristles are attached to the pedestal which is disposed in a predetermined manner along the runner. The pedestal is within, and does not extend beyond the side edges of the runner and includes an upright wall that extends transversely relative to a flat lower base that is transversely disposed relative to the runner for securing the device to the runner wherein the bristles have their upper free ends at least the same height as the toe piece. The pedestal also includes an upper base for securing the bristles to the pedestal. Means are provided for securing the pedestal to the runner. Such means includes a base plate having means mounting to the toe piece and means for mounting to the runner. The pedestal is fixed to the base plate.

In another aspect, the invention provides a snow removal device substantially as described above. It differs, however, insofar as the base plate includes means for mounting a toe piece base plate thereto and means for mounting to the runner. The pedestal is fixed to the base plate.

The preceding and other aspects and advantages of the present invention will become further apparent from the detailed description that follows. The description includes a written portion and drawing figures. Numerals of the drawing figures, corresponding to those of the written description, point to the features of this invention, like numerals referring to like features throughout.

BRIEF DESCRIPTION OF THE DRAWINGS

The above-mentioned and other objects and features of the present invention and the manner of attaining them will become apparent, and the invention itself will be best understood by reference to the following description of the embodiments of the invention, taken in conjunction with the accompanying drawings, wherein.

DETAILED DESCRIPTION

Figure 1:
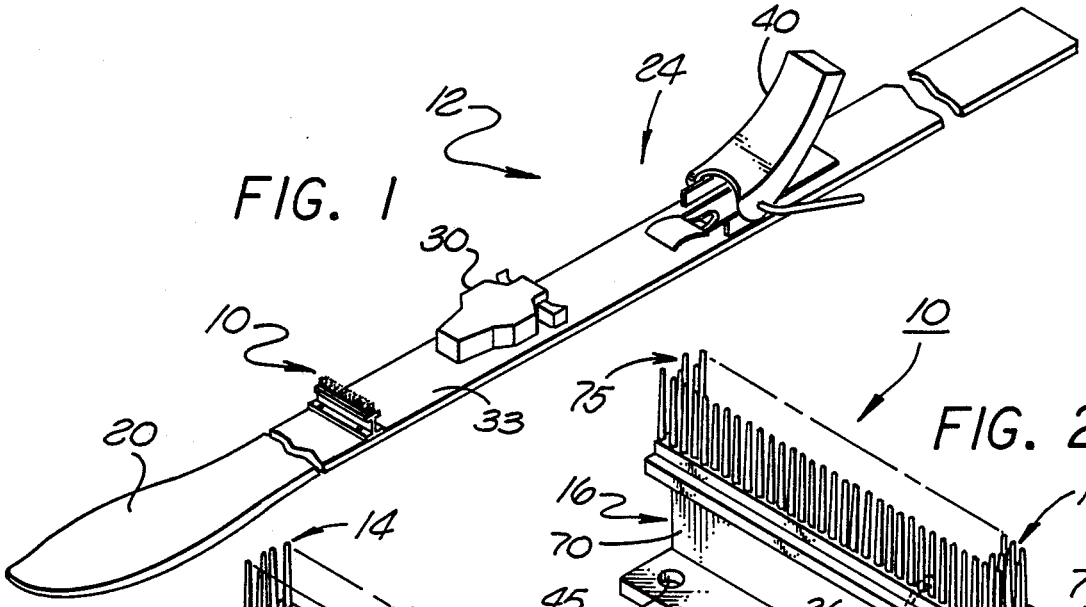
FIG. 1 is a pictorial fragmentary view of a ski assembly including a snow removal device which is constructed in accordance with the present invention.
Figure 2:
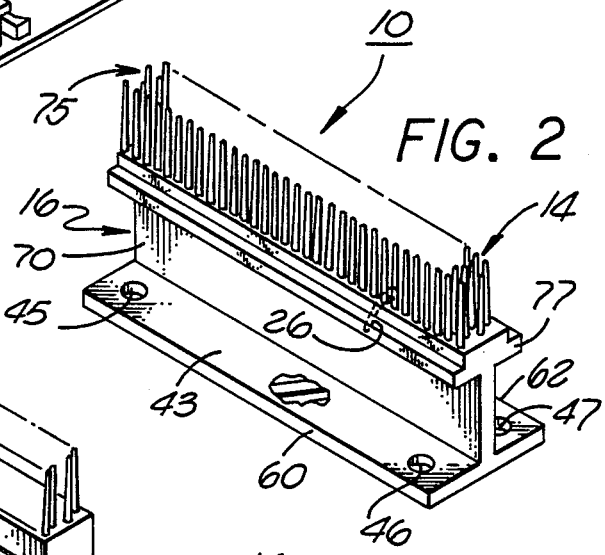
FIG. 2 is an enlarged pictorial view of the snow removal device of FIG. 1.

Referring now to the drawings, and more particularly to FIGS. 1 and 2 thereof, there is illustrated a snow removal device 10 which is constructed in accordance with the present invention, and which is used in conjunction with a ski assembly 12. The device 10 generally includes a plurality of particularly designed tilted forward spaced-apart bristles, which are collectively indicated at 14 and which are secured fixedly to a pedestal 16.

By securing the pedestal 16 at a predetermined disposition along the upper surface of a runner 20, the skier is capable of removing the snow or ice which has built up within the crevices of his or her ski boot (not shown). While only one snow removal device 10 is illustrated as being secured to one runner 20, it should be understood that another snow removal device (not shown) can also be secured in a substantially similar manner to another runner (not shown).

In use, the skier simply cleans the upper surface of the runner with an appropriate cleansing material and positions the device 10 at a predetermined distance forward of the binding mechanism 24 of the ski assembly 12. The device 10 can thereafter be secured to the runner 20 by suitable means such as an adhesive or other conventional device. The skier then wipes the undersole of his or her boot against the bristles 14 prior to stepping into the ski binding mechanism 24. The bristles 14 follow the crevices of the undersole and cause the snow packed therein to be loosened and removed therefrom.

Once thrust, the bristles 14 must flex close to the point of attachment to the pedestal 16, as indicated in phantom lines at 26, in order to produce an optimal reactive or "catapult" effect for ejecting the snow out of the crevices, upon resuming their unstressed condition. Therefore, the compacted snow can now be removed expeditiously and conveniently, and the risk of danger caused by the snow buildup inside the crevices of the undersole is thus substantially reduced, if not eliminated. It is necessary for the bristles to flex close to the pedestal. Snow freezes solid below the flexing point, which makes short or thick bristles, or bristles that flex at their midpoints totally ineffective.

Considering now the pedestal 16 in greater detail with respect to FIG. 2, it secures the bristles 14 to the runner 20 and provides the necessary elevation and forward angle thereto, for ensuring the proper use of the device 10. In this regard, the pedestal 16 includes a lower base 43 for fixedly securing the device 10 to the runner. The pedestal 16 has a thermoplastic composition and can be produced relatively inexpensively by conventional molding techniques, such as by injection-molding. The pedestal 16 may be of metallic or elastomeric composition. A polyethylene or nylon material gives such device 10 a generally flexible and compliant composition. A more rigid device may be formed from a conventional aluminum extrusion.

As illustrated in FIG. 2, the lower base 43 includes a plurality of spaced-apart mounting holes, such as the holes 45, 46 and 47 for receiving corresponding mounting screws (not shown) in order to secure the lower base 43 to the runners 20. It should, however, be understood that other means for fixing the pedestal 16 to the runner 20 can be used. For instance, one side of a double-sided adhesive strip, such as the adhesive strip 48 shown in FIG. 3, can be fixed to the underside of the lower base 43, while the other side thereof can be affixed to the upper surface 33 of the runner 20. It has been experimentally demonstrated that an adhesive strip having an overall bonding surface of about three (3) square inches is sufficient to withhold securely the device 10 to the runner 20. It has been found to be desirable to employ a strong bonding pedestal material such as polyvinyl chloride when using an adhesive strip.

The lower base 43 has a generally flat rectangular configuration and has its parallel sides 60 and 62 transversely arranged relative to the runner 20. Furthermore, the length of the sides 60 and 62 are commensurate with the width of the runner 20. In this manner, the base member 43 does not extend beyond the side edges of the runner 20.

The pedestal 16 is generally positioned at a predetermined distance from the toe piece 30 of the binding mechanism 24, for enabling the skier to wipe the sole of his or her other boot in a convenient manner. In this regard, it has been found that the preferred disposition of the pedestal 16 along the upper surface 33 of the runner 20 is between the range of one (1) inches to nine (9) inches in front of the toe piece 30. Thus, the skier can access the device 10 with his or her boot without having to assume an uncomfortable or awkward position. It will become apparent to those skilled in the art after reviewing the present description that the device 10 can be positioned at other locations along the upper surface 33 of the runner 20. Alternatively, the pedestal 16 may be formed integral with the binding toe piece 30 to simplify manufacture and assembly.

Such inventive disposition of the device 10 relative to the binding mechanism 24 is important to the proper use of the device 10. In fact, if the device 10 were disposed behind the heel piece 40 rather than in front of the toe piece 30, the skier would have to assume an awkward and uncomfortable bending position, and the bristles 14 would impact the undersole of the ski boot angularly rather than normally.

Similarly, if the device 10 were secured to the runner 20 at a distance greater than the upper nine (9) inches limit in front of the toe piece 30, the skier would need to assume a generally uncomfortable position. Furthermore, should the device 10 be positioned at a substantially lesser distance than the one (1) inches limit, then the snow would tend to build up between the toe piece 30 and the device 10. Such snow buildup can cause the binding mechanism 24 in general and the toe piece 20 in particular to become frozen and, hence, inoperative and hazardous. Additionally, the toepiece would be subjected to repeated kicks of the boot, eventually causing damage.

An upright wall 70 extends integrally transversely to the lower base 43 at a generally right angle thereto, and it is disposed at about the middle thereof, for providing the proper elevation for the bristles 14. In this respect, the wall 70 is dimensioned so as to allow the upper free ends 75 of the bristles 14 to be at least at about the same height as the toe piece 30.

Such height is preferable in that it tends to provide an unobstructed use of the device 10 by preventing the boot from impacting with the toe piece 30 and thus causing it to be damaged. The wall 70 is generally flat and rectangular in shape and has a thickness that is particularly designed to give the device 10 a sufficient resistance to accidental or even voluntary impacts. It has been found that a thickness of 0.2 inch is the preferred dimension for the wall 70. However, other sizes can be used as well.

Figure 6A:
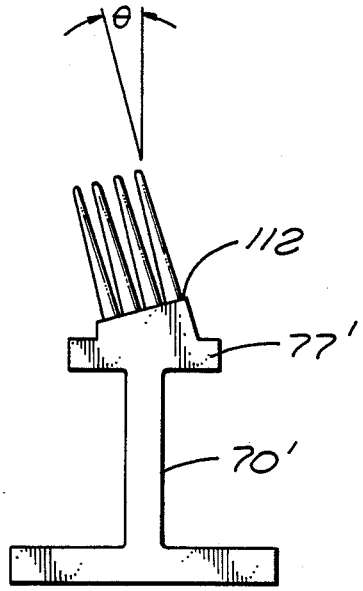
FIGS. 6A and 6B are enlarged side views of alternative embodiments of the snow removal device, such embodiments being based generally upon the arrangements previously illustrated in FIGS. 2 and 5 respectively.
Figure 6B:
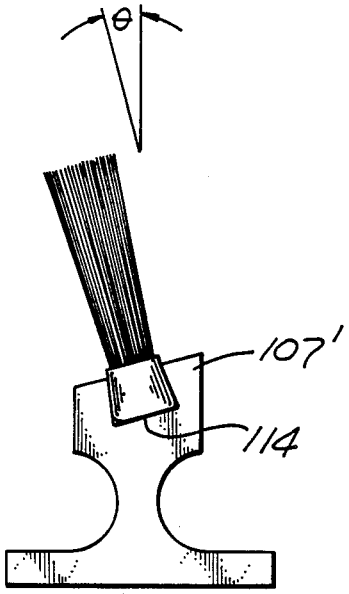

An upper flat base 77 extends integrally transversely from the walls 70 at a forward angle thereto, as discussed with respect to FIGS. 6A and 6B, and it is disposed in a generally parallel manner to the lower base 43. The upper base 77 has a generally rectangular shape and has a smaller surface than the lower base 43. In this manner, the skier can access the mounting holes 45, 46 and 47 readily for tightening the lower base 43 to the runner 20 by means of mounting screws.

The wall 70 and the upper base 77 have generally similar lengths to that of the lower base 43 so that the device 10 does not extend beyond the side edges of the runner 20. In this manner, the device 10 does not present a hazard to the user.

Thus, the pedestal is designed to provide an attachment as well as a sufficient elevation and forward angle to the bristles 14. In this regard, the bristles 14 are anchored to the upper base 77 and have a generally resilient composition. As shown in FIG. 2, the device may comprise an integral plastic piece formed by plastic mold injection. The bristles 14 are preferably made of suitable thermoplastic material, such as polyethylene or 6112 nylon, which has a relatively high tensile strength at temperatures ranging from −50° F. to 100° F. Particularly, the selected material should have a good resilient memory at colder temperatures, and it should have a low moisture absorption coefficient.

The bristles 14 are generally between one-half (½) inch and two (2) inches in length. However, the preferred length of the bristles 14 is about 1 inch. Such length prevents the snow from building up and freezing over inside the bristles 14. Thus, if the bristles 14 were substantially longer than 2 inches, they would not be sufficiently rigid to remove the built-up snow from within the crevices of the undersole of the ski boot. Furthermore, if the bristles 14 were substantially shorter than one-half (½) inch, the snow would tend to buildup and to freeze over within the bristles 14.

The individual diameter of the bristles 14 is generally selected so as to enable them to flex at near their anchored ends, as illustrated at 26 in FIG. 2. Hence, when the stressed bristles 14 resume their unstressed condition, they tend to loosen and to eject the compacted snow within the crevices of the undersole. This is necessary to prevent the bristles from becoming frozen solid and rendering the device useless.

The preferred width of individual bristles 14 ranges between five one-thousandth (5/1000) of an inch to one hundred one-thousandth (100/1000) of an inch. While the bristles 14 are illustrated in FIG. 2 as being spaced apart to one another, it should be understood that the bristles 14 can be more distantly separated or more closely compacted.

Figure 3:
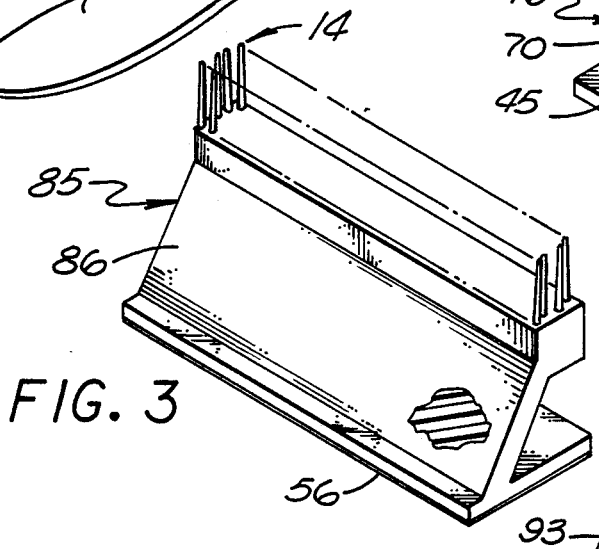
FIG. 3 is an enlarged pictorial view of another snow removal device which is constructed in accordance with the present invention.

FIG. 3 shows another snow removal device 85 which is constructed in accordance with the present invention. The snow removal device 85 is generally similar to the snow removal device 10 shown in FIG. 2, with the exception of the shape of its pedestal 86. In this regard, while the pedestal 86 serves substantially the same purpose as the pedestal 16 of the snow removal device 10, the pedestal 86 has a different shape than the pedestal 16. The shape of pedestal 86 adds to the aesthetic appearance of the device 85.

Figure 4:
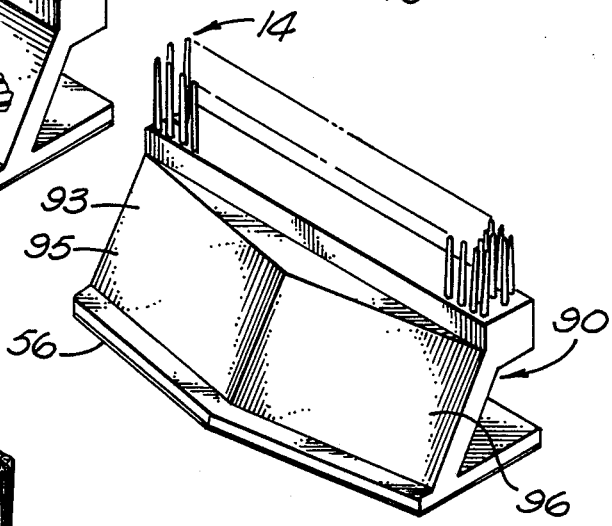
FIG. 4 is an enlarged pictorial view of yet another snow removal device which is also constructed in accordance with the present invention.

FIG. 4 illustrates another snow removal device 90 which is constructed in accordance with the present invention. The snow removal device 90 is generally similar to the snow removal device 85 with the exception of the shape of the pedestal 93. In this regard, the pedestal 93 has an aesthetically pleasing appearance, as well as an aerodynamic shape for causing the snow particles to slide along its slanted forward surfaces 95 and 96, for substantially reducing, if not eliminating the snow buildup on the device 90.

Figure 5:
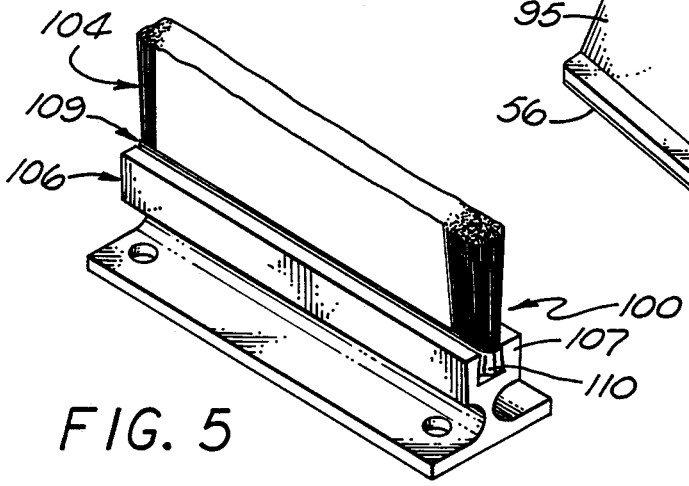
FIG. 5 is an enlarged pictorial view of a snow removal device which is constructed in accordance with the present invention.

FIG. 5 illustrates another snow removal device 100 which is constructed in accordance with the present invention. The snow removal device 100 is substantially similar to the snow removal device 10 with the exception of the bristles 104. In this regard, the bristles 104 are very closely compacted and are formed of thinner fibrous thermoplastic material. The bristles 104 provide the skier with a smooth and soft wiping contact. The snow removal device 100 further includes a pedestal 106 which is substantially similar to the pedestal 16 of the snow removal device 10, with the exception that the pedestal 106 includes an upper base 107 which is generally channel-shaped for receiving the bristles 104 in a friction-fit manner. The lower ends 109 of the bristles 104 are collectively entered and compacted within a generally metallic U-shaped guide 110. The guide 110 fits snugly and frictionally within the elongated channel-shaped upper base 107.

FIGS. 6A and 6B are side views of alternative embodiments of the invention that correspond generally to those of FIGS. 2 and 5 described above. In the figures, primed numerals point to the corresponding structures. Unlike the snow removal devices already discussed, each of the devices of FIGS. 6A and 6B is modified so that the bristles of such devices are inclined at an angle $\theta$ to the normal. In the embodiment of FIG. 6A such a degree of inclination is attained by machining a corresponding amount of "tilt" into the upper surface 112 of the upper base 77'. The inclination of the bristles is attained in the embodiment of FIG. 6B by "cocking" the upper base 107' in such a way as to tilt the interior channel 114 for receiving the bristles by the corresponding angular amount.

Figure 7:
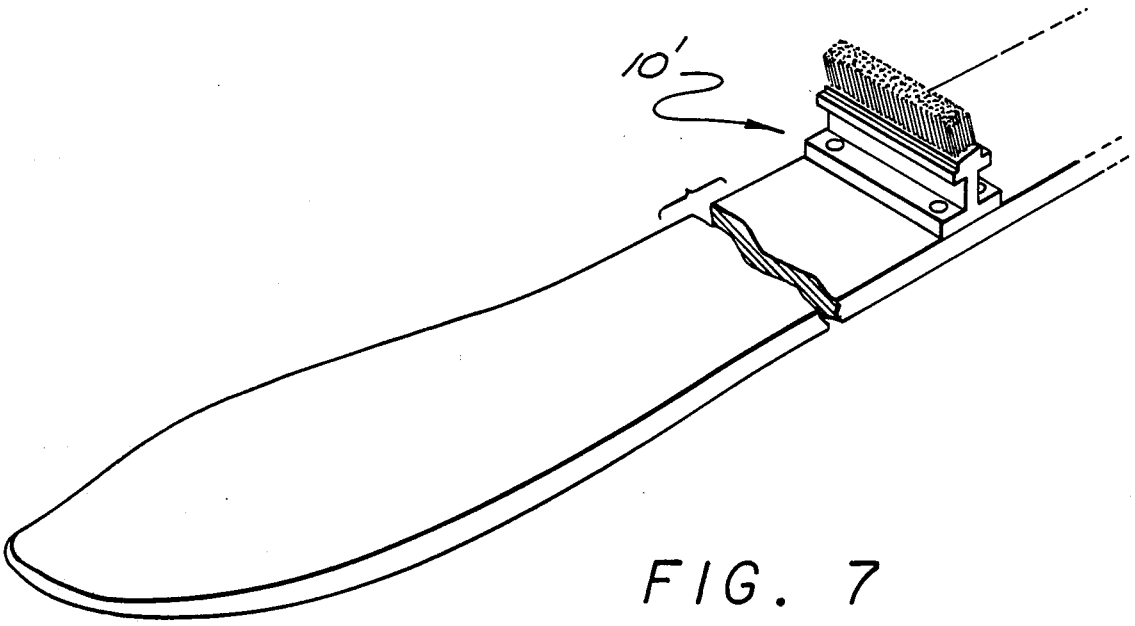
FIG. 7 is an enlarged pictorial fragmentary view of a ski assembly including a snow removal device in accordance with the embodiment of FIG. 6A.

FIG. 7 is an enlarged pictorial fragmentary view of a ski assembly that includes a snow removal device, such as that of FIG. 6A, with inclined bristles. As shown, the snow removal device 10' is mounted so that the tips of the bristles are forwardly-inclined (i.e. pointing toward the front tip of the runner 20). The degree of inclination is preferably about fifteen (15) to forty-five (45) degrees. By so modifying the device 10', the digging and scooping power of the invention for removing stubborn snow and ice from the bottom of the skier's boot is enhanced. This follows from the change in the bristle "attack angle" with respect the bottom of the boot of the standing skier. Additionally, by inclining the bristles as shown, the use of the invention is further facilitated by providing the skier with a smoother leg swing and added spacing or clearance from the binding.

Figure 8:
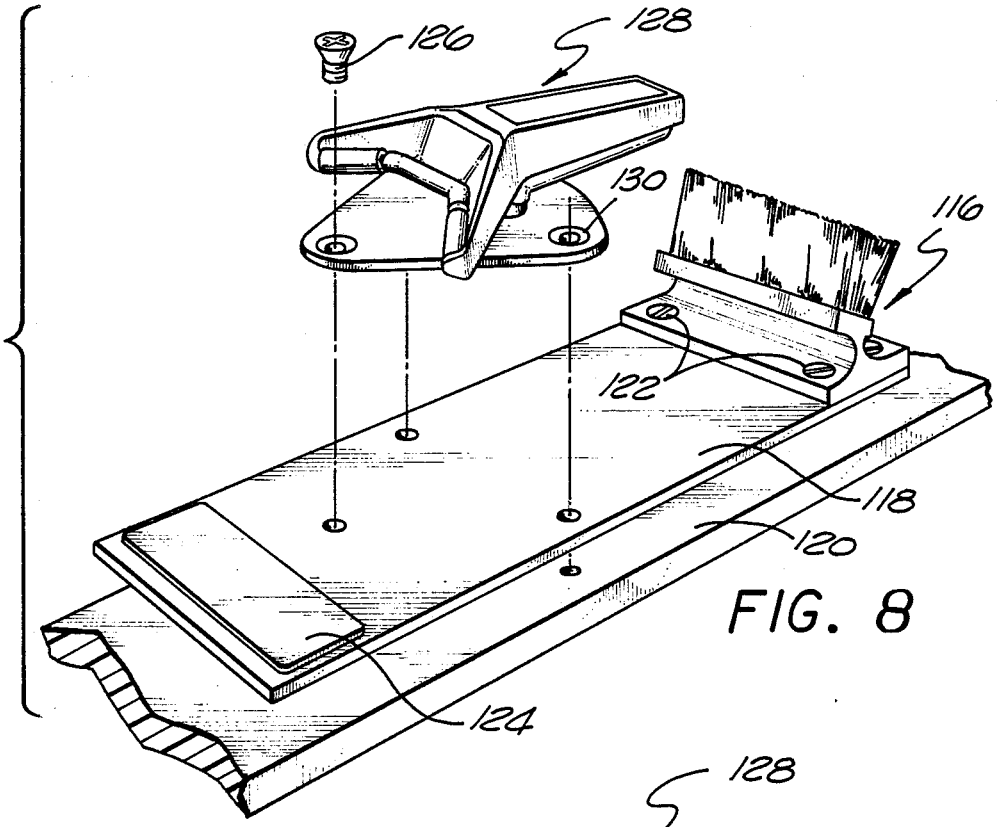
FIG. 8 is an exploded perspective view of an alternative embodiment of the present invention wherein the base plate of the snow removal device is integral with the pedestal.
Figure 9:
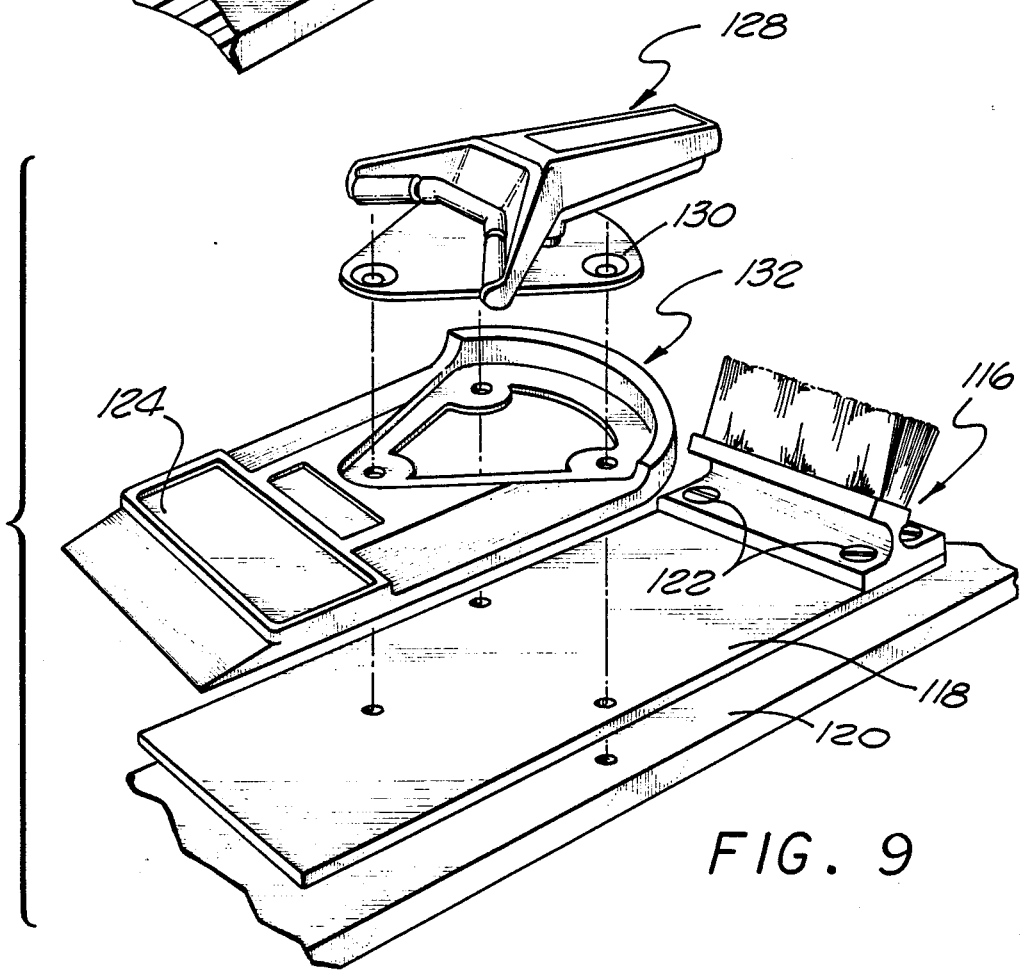
FIG. 9 is an exploded perspective view of a further alternative embodiment of the present invention wherein the base plate of the snow removal device is integral with the pedestal.

FIGS. 8 and 9 disclose alternative embodiments of the invention wherein a pedestal 116 (shown to include forward-tilted bristles) is made integral with a toe piece 128 by means of an interfacing base plate 118. In each such embodiment, the toe piece 128 and the pedestal 116 comprise separate parts. As shown in FIG. 8, the pedestal 116 is fixed to a base plate 118 by means of screws 122 or like fastening means. The base plate 118 is preferably formed of metal (aluminum or steel), ABS or like thermoplastic material. In the event that the base plate 118 is metal, it may be formed by stamping or like fabrication processes. An injection molding process may be utilized to form a plastic base plate. An antifriction pad 124 of Teflon composition may be fixed to the base plate 118 to keep the ski boot from sticking and to permit it to slide from side to side, thereby facilitating operation of the release mechanism of the binding. Epoxy or other appropriate fastening agent may be employed to attach the pad 124 to the base plate 118.

The base plate 118 is fixed to the ski or runner 120 by means of screws, such as that shown at 126, which also serve to attach the toe piece 128 thereto. The toe piece 128 is of a type that includes a toe piece flange 130 that provides a location for such screws so that the runner 120, the base plate 118 and the flange 130 form a sandwich arrangement when fastened together by means of the screws 126.

The configuration of the toe piece 128 as shown in FIGS. 8 and 9 is representative of a commonly used class of bindings that includes, for example, the GT series manufactured by Look, Inc. A variation of the embodiment of the base plate 118 is shown in FIG. 9. Unlike the base plate of the preceding figure, the antifriction pad 124 is not attached to the base plate of FIG. 9. Rather, the pad 124 is fixed to a conventional toe piece base plate 132 of the type that is especially manufactured to provide an interface between the runner 120 and the toe piece 128. While the toe piece base plate does not form a portion of the present invention, it may readily be seen from the arrangement shown in FIG. 9 that the base plate 118 is easily modified to accommodate a conventional toe piece 128-plus-toe piece base plate 132 combination of the type shown in FIG. 9.

Figure 10:
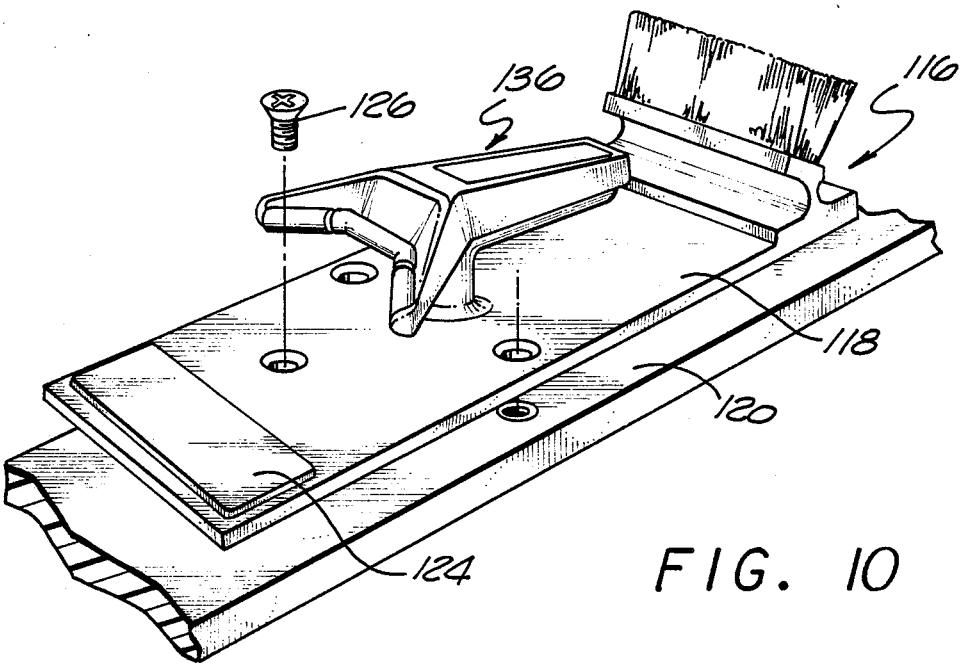
FIG. 10 is an exploded perspective view of an alternative embodiment of the present invention wherein the base plate of the snow removal device is formed integral with the toe piece of a ski binding.
Figure 11:
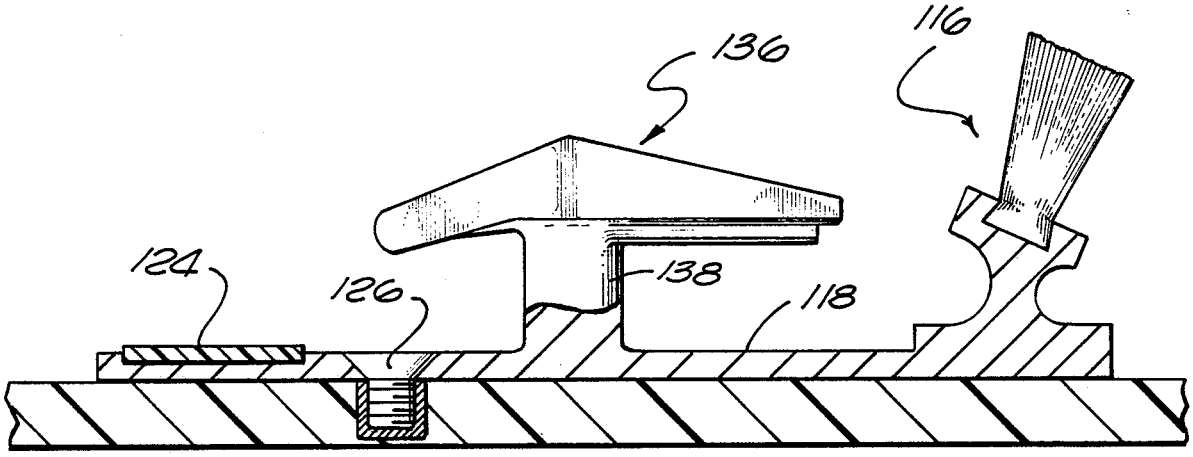
FIG. 11 is a side elevation, partially sectional view of the alternative embodiment of FIG. 10.

FIGS. 10 and 11 are exploded perspective and partial sectional side elevation views respectively of a further alternative embodiment of the invention. In the particular embodiment disclosed in those views, the base plate 118 is formed integral with the toe piece 136. As shown in FIG. 11, a toe piece support shaft 138 attaches directly to the base plate 118.

While particular embodiments of the present invention have been disclosed, it is to be understood that various different modifications are possible and are contemplated within the true spirit and scope of the appended claims. Therefore, there is no intention of limitation to the exact abstract or disclosure herein presented.

What is claimed is:

1. As snow removal device for use in conjunction with a runner of a ski assembly, said runner having a pair of generally parallel side edges, a toe piece and a heel piece, said device comprising, in combination:

(a) a pedestal which is secured fixedly and arranged transverse to the runner, said pedestal being made of polyethylene material;

(b) a plurality of upright bristles of thermoplastic material which are attached to said pedestal;

(c) said pedestal being disposed in a predetermined arrangement along the runner within, and not extending beyond said side edges and including an upright wall that extends transversely relative to a flat lower base transversely disposed relative to said runner for securing said device to said runner wherein said bristles have their upper free ends at least the same height as the toe piece, an upper base for securing said bristles to said pedestal; and (d) means for securing said pedestal to the runner including a base plate having means for mounting said toe piece thereto and means for mounting said base plate to said runner, said pedestal being fixed to said base plate.

2. A device as defined in claim 1 wherein said base plate and said toe piece comprise a single integral device.

3. A device as defined in claim 2 wherein said base plate further includes an antifriction pad.

4. A device as defined in claim 2 wherein said base plate is further characterized in that:

(a) said pedestal is located adjacent the front edge of said base plate; and (b) said antifriction pad is located behind said toe piece.

5. A snow removal device for use in conjunction with a runner of a ski assembly, said runner having a pair of generally parallel side edges, a toe piece thereto and a heel piece, said device comprising, in combination:

(a) a pedestal which is secured fixedly and arranged transverse to the runner and integral with said toe piece, said pedestal being made of polyethylene material;

(b) a plurality of upright bristles of thermoplastic material which are attached to said pedestal;

(c) said pedestal being disposed in a predetermined arrangement along the runner within, and not extending beyond said side edges and including an upright wall that extends transversely relative to a flat lower base transversely disposed relative to said runner for securing said device to said runner wherein said bristles have their upper free ends at least the same height as the toe piece, an upper base for securing said bristles to said pedestal; and (d) means for securing said pedestal to the runner including a base plate integral with said pedestal and said toe piece and means for mounting said base plate to said runner.

* * * * *